United States Patent [19]

Schiavone

[11] 4,131,894

[45] Dec. 26, 1978

[54] HIGH EFFICIENCY MICROSTRIP ANTENNA STRUCTURE

[75] Inventor: Frank J. Schiavone, Longmont, Colo.

[73] Assignee: Ball Corporation, Muncie, Ind.

[21] Appl. No.: 788,603

[22] Filed: Apr. 15, 1977

[51] Int. Cl.[2] ..... H01Q 1/38; H01Q 1/42; H01P 3/00

[52] U.S. Cl. ..... 343/700 MS; 343/789; 333/84 M

[58] Field of Search ..... 333/73 S, 84 M; 343/705, 706, 707, 708, 700 MS, 789

[56] References Cited

U.S. PATENT DOCUMENTS

| | | | |
|---|---|---|---|
| 2,760,169 | 8/1956 | Engelmann | 333/84 M |
| 3,102,244 | 8/1963 | Seidel | 333/84 M |
| 3,904,997 | 9/1975 | Stinehelfer, Sr. | 333/84 M |
| 4,063,246 | 12/1977 | Greiser | 343/700 MS |

FOREIGN PATENT DOCUMENTS

| | | | |
|---|---|---|---|
| 798821 | 7/1958 | United Kingdom | 343/708 |

*Primary Examiner*—Alfred E. Smith
*Assistant Examiner*—Harry E. Barlow
*Attorney, Agent, or Firm*—J. David Haynes

[57] ABSTRACT

A microstrip antenna wherein a cavity or channel is formed in the ground plane conductor to reduce radiation losses and cross-coupling between elements. A shielded embodiment is also disclosed.

16 Claims, 3 Drawing Figures

Fig. 1
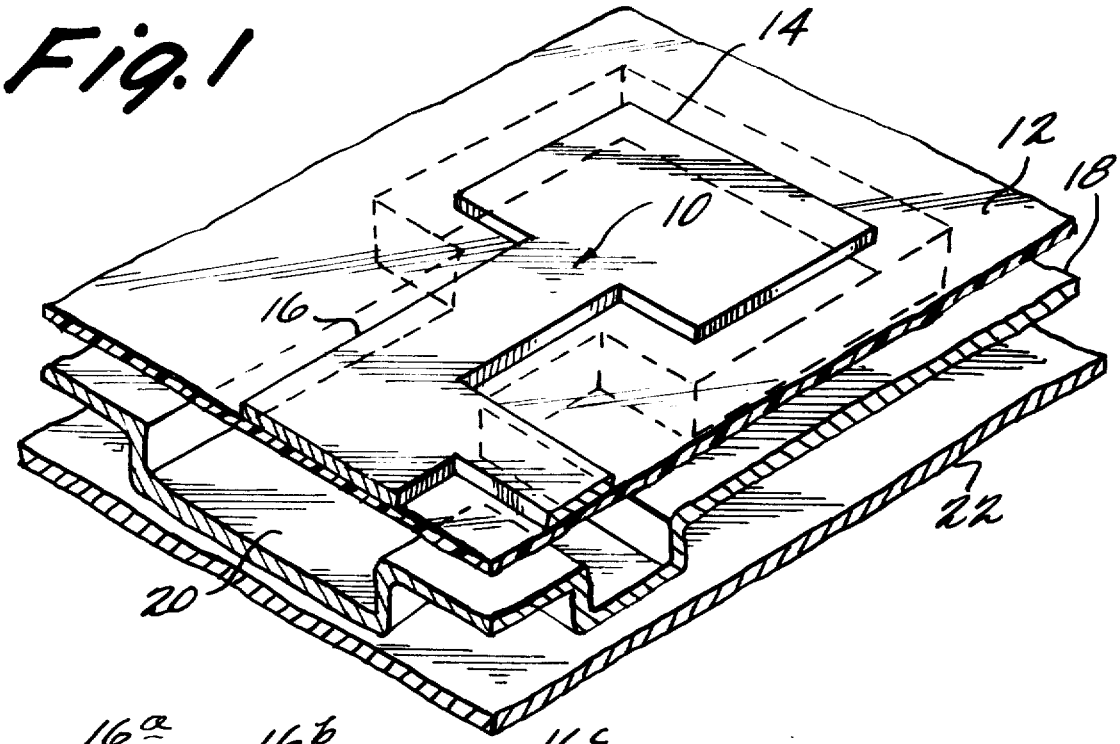
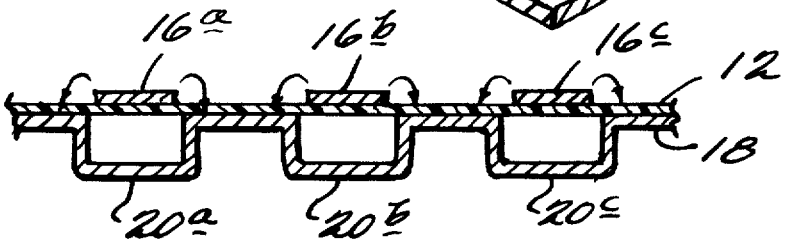
Fig. 2
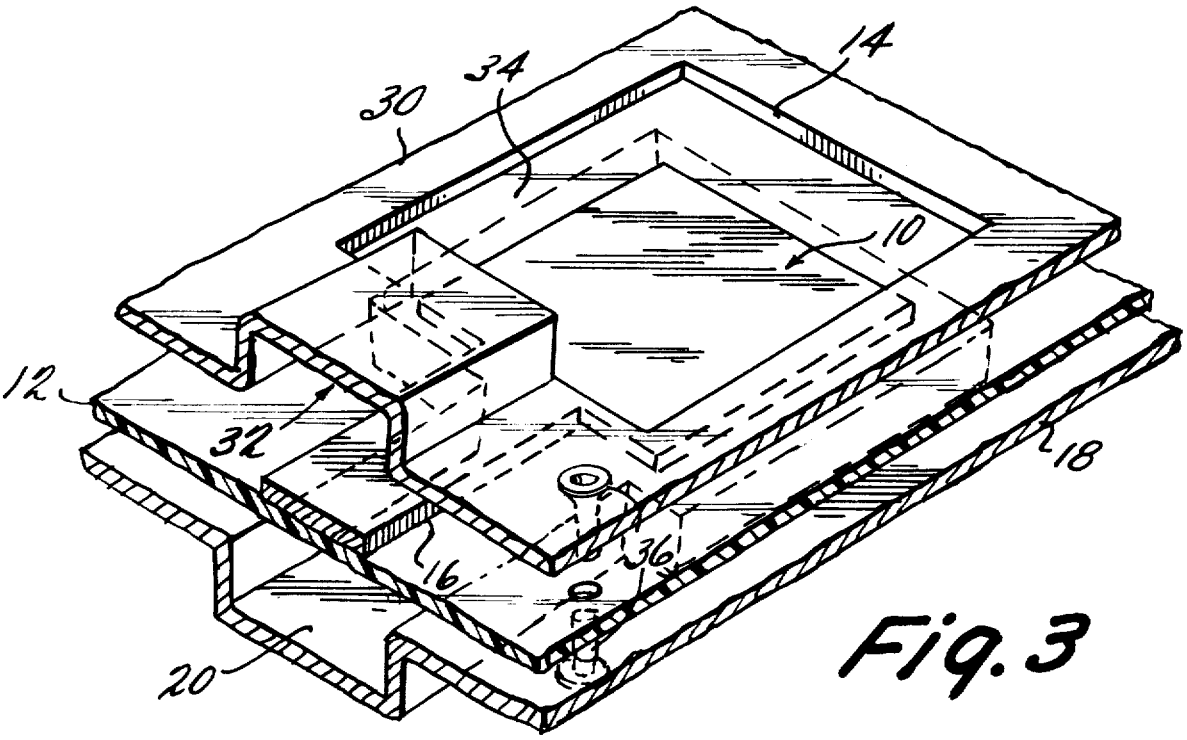
Fig. 3

HIGH EFFICIENCY MICROSTRIP ANTENNA STRUCTURE

CROSS REFERENCE TO RELATED COPENDING APPLICATIONS

Of interest is copending application Ser. No. 666,174, now abandonded, entitled "High Efficiency, Low Weight Antenna" filed on Mar. 12, 1976 by R. Munson and G. Sanford and commonly assigned with the present invention to Ball Corporation.

The present invention relates to antenna structues and, in particular, to microstrip antenna structures.

In general, microstrip radiators are specially shaped and dimensioned conductive surfaces formed on one surface of a planar dielectric substrate, the other surface of such substrate having formed thereon a further conductive surface commonly termed the "ground plane". Microstrip radiators are typically formed, either singly or in an array, by conventional photoetching processes from a dielectric sheet laminated between two conductive sheets. The planar dimensions of the radiating element are chosen such that one dimension is on the order of a predetermined portion of the wavelength of a predetermined frequency signal within the dielectric substrate and the thickness of the dielectric substrate chosen to be a small fraction of the wavelength. A resonant cavity is thus formed between the radiating element and ground plane, with the edges of the radiating element in the non-resonant dimension defining radiating slot apertures between the radiating element edge and underlying ground plane surface. For descriptions of various microstrip radiator structures, reference is made to U.S. Pat. Nos. 3,713,162 issued Jan. 23, 1973 to R. Munson et al.; 3,810,183 issued May 7, 1974 to J. Krutsinger et al.; and 3,811,128 and 3,921,177, respectively, issued on May 7, 1974 and on Nov. 18, 1975 to R. Munson and also to copending applications Ser. Nos. 607,418 filed Aug. 25, 1975 by R. Munson issued as U.S. Pat. No. 3,971,032; 596,263 filed July 16, 1975 by J. Krutsinger et al. issued as U.S. Pat No. 3,810,183 and reissued as U.S. Pat. Re29,296; 683,203 filed May 4, 1976 by G. Sanford; 630,196 filed Oct. 6, 1975 by G. Sanford issued as U.S. Pat. No. 4,070,676; 658,534 filed Feb. 17, 1976 by L. Murphy issued as U.S. Pat. No. 4,051,477 and 723,643 filed Sept. 15, 1976. by M. Alspaugh et al., and 759,856 filed Jan. 1, 1977 by G. Sanford et al. — all commonly assigned with the present invention to Ball Corporation.

In the past, microstrip antenna structures have typically utilized a solid dielectric sheet as a substrate, such as Teflon-fiberglass. A continuous conductive sheet is laminated to one side of the dielectric sheet to form the ground plane. Conductive strip elements are formed on the opposing side of the dielectric sheet to form a predetermined configuration of microstrip antenna patches and feedlines, typically by photoetching a continuous conductive sheet previously laminated on the dielectric. Generally an array of a plurality of antenna patches and associated feedlines are formed as a unitary "printed circuit".

A major problem associated with microstrip antenna structures is that the edges of the feedlines and ground plane conductor form radiating apertures of sorts, in addition to the antenna patch radiation apertures. The radiation from the feedline edges is proportional to the dielectric constant and thickness (h) relative to the free space wavelength of the antenna operating frequency.

More specifically, feedline radiation is porportional to $(h/\lambda_O)^2$. Where an adjacent element or feedline is disposed within the pattern of the feedline, radiation cross-coupling can occur. Cross-coupling typically destructively affects the relative phasing of the array elements, and is manifested by higher average level sidelobes in the array radiation pattern. Thus, to avoid cross-coupling and minimize the planar size of an array, it would appear that it is desirable to utilize a dielectric sheet of minimum thickness. However, it has been observed that antenna efficiency is directly proportional to the thickness of the dielectric substrate. Thus, an apparent dilemma arises.

The present invention is directed to a microstrip antenna structure wherein a channel is formed in a continuous conductive sheet ground plane, underlying the strip line elements, to provide for high antenna efficiency while minimizing cross-coupling between elements in an array of given planar size.

Preferred embodiments of the present invention will now be described with reference to the accompanying drawing, in which like numerals denote like elements and:

FIG. 1 is an exploded perspective illustration of a microstrip antenna in accordance with one aspect of the present invention;

FIG. 2 is a sectional view of a plurality of adjacent feedlines in accordance with the present invention; and FIG. 3 is an exploded perspective illustration of a shielded microstrip antenna structure in accordance with a further aspect of the present invention.

Referring now to FIG. 1, a conductive sheet 10 is formed, suitably by conventional photoetching techniques, on one side of a thin dielectric sheet 12. Conductive sheet 10 includes an antenna patch portion 14 and feedline portion 16. As will be appreciated, the dimensions of antenna patch 14 and feedline 16 are in accordance with the desired impedance and operational frequency of the antenna structure. Dielectric sheet 12 can be formed of Teflon-fiberglass, as is common in the art, or can be a Mylar sheet. A conductive sheet 18 is disposed under dielectric sheet 12, serving as a ground plane. A channel 20 of predetermined depth and having sides transverse to the plane of dielectric sheet 12 is formed in conductive sheet 18 underlying and having the same general shape as conductor 14. The depth of channel 20 is, inter alia, a determinative factor of the impedance of, for example, feedline 16. It should be appreciated, however, that in view of the low dielectric constant of air, variances on the order of $\pm 1$ mil can generally be tolerated for operating frequencies up to approximately 15 GHz. The width of channel 20 with respect to conductor 10 is not critical, although it is desirable that channel 20 generally conform to the planar shape of conductor 10 to effect shielding against cross-coupling between elements, as will be explained. Further, it is generally desirable that channel 20 be at least as wide as the overlying portion of conductive sheet 10 and preferably such that the transverse sides of channel 20 are separated from the edges of conductor 10 by a distance in the plane of conductor 10 approximately equal to the depth of channel 20. A backing plate 22 may also be utilized for the structural support, formed of any suitable material, such as metal or epoxy fiberglass.

Channel 20 may be formed by conventional metal stamping, machining or molding techniques. Alternatively, conductive sheet 18 and channel 20 can be formed by molding epoxy fiberglass or the like into the desired configuration and depositing a layer of metal such as copper, aluminum or silver on the surface of the fiberglass mold.

It should be appreciated that, in the alternative, conductors 10 and 18 can be disposed on the same side of dielectric sheet 12, channel 30 encompassing conductor 10 and having sides again preferably separated from the adjacent edges of conductor 10 by a distance approximately equal to the depth of channel 20.

Briefly, in operation, a signal to be radiated is applied via feedline 16 to antenna patch 14. The specific dimensions and configuration of feedline 16 are determined, as is appreciated in the art, in accordance with, inter alia, the specific relative phasing of the signal to be radiated by antenna patch 14 with respect to the applied signal. A resonant cavity is formed between patch 14 and ground plane conductor 18, with one or more edges of patch 14 defining radiating apertures.

As noted above, cross-coupling between elements generally occurs when an adjacent microstrip element is disposed within the radiation pattern from the "aperture" between edges of microstrip feedline 16 and ground plane conductor 18. The width of such pattern is directly proportional to the distance between feedline 16 and conductor 18. In accordance with one aspect of the present invention, channel 20 provides a low loss air dielectric and relatively large non-loaded area directly underlying feedline 16, while the sides of the channel and remainder of conductive sheet 18 are relatively proximate to the plane of conductor 10. The width of the feedline radiation pattern is thus limited by, in effect, providing an elevated ground shield between adjacent elements. Such shielding effect is shown diagrammatically in FIG. 2.

Three adjacent feedlines **16*a*, 16*b* and 16*c* are disposed on dielectric sheet 12 and supply phased signals to respective radiators (not shown). In accordance with the present invention, channels 20*a*, 20*b* and 20*c* are formed in ground plane 18 underlying conductor 16*a*, 16*b* and 16*c*. The thickness of dielectric sheet 12, and thus the distance between adjacent portions of conductors 10 and 18, is such that potentially cross-coupling radiation from the edges of feedline 16*a*, 16*b* and 16*c* are, in effect, intercepted by the portions of conductive sheet 18 adjacent to dielectric sheet 12. Thus, it should be appreciated that a dielectric sheet of comparable thickness could not be utilized in prior art antenna structures without substantially reducing the antenna structures without substantially reducing the efficiency of the antenna. Cross-coupling between the feedlines 16*a*, 16*b* and 16*c*** is substantially reduced as compared to a conventional microstrip antenna array structure of similar planar size and efficiency.

Cross-coupling can be substantially eliminated by the addition of a further conductive sheet disposed on the surface of dielectric substrate 12 bearing conductive sheet 10. Such a conductive sheet 30 is shown in FIG. 3. Conductive sheet 30 includes a channel 32 overlying feedline 16 and a cutout or opening 34 overlying and encompassing antenna patch 14. Channel 32 is of predetermined height, typically equal to the depth of channel 20, and of generally the same configuration as feedline 16. The sides of channel 32 and edges of opening 34 are preferably separated from the adjacent edges of conductor 10 by a distance approximately equal to the height of channel 32. Conductive sheet 30 is electrically connected to conductive sheet 18 by, for example, a conductive rivet or screw 36. Rivet 36, or a plurality of such rivets, can be utilized to fix conductive sheets 18 and 30 and dielectric sheet 12 in a fixed rigid structure. It should be appreciated that channels 20 and 32 effectively contain all radiation from feedline 16, thereby substantially eliminating cross-coupling between feedlines and preventing distortion of the relative phasing of the radiating elements in an array.

Microstrip antenna structures in accordance with the present invention have been built in 2 × 2 and 4 × 8 arrays for operation in the range of approximately 1.275–1.4 GHz.

It will be understood that the above description is of illustrative embodiments of the present invention and that the invention is not limited to the specific form shown. Modifications may be made in the design and arrangement of the elements without departing from the spirit of the invention as will be apparent to those skilled in the art.

What is claimed is:

1. In an apparatus for radiating microwave frequency signals of the type including a first conductive sheet element of predetermined planar configuration, said first conductive sheet element including a feedline portion and a microstrip antenna patch portion and a second conductive sheet element, said first conductive sheet element overlying said second conductive sheet element, and being separated therefrom by a dielectric substance, the improvement wherein:

said second conductive sheet element is indented to a predetermined depth in the vicinity of said first conductive sheet element, to form a channel void underlying both said feedline portion and said microstrip antenna patch portion of said first conductive sheet element.

2. The apparatus of claim 1 wherein said microstrip antenna patch portion of said first conductive sheet element and second conductive sheet element define a radiating aperture and said apparatus further includes:

a third conductive sheet element overlying said first conductive element, said third conductive sheet element being indented in the vicinity of said first conductive sheet element, to form a further channel void over a first portion of said first conductive sheet element, and including an opening encompassing said radiating aperture, said third conductive sheet element being electrically connected to said second conductive sheet element.

3. The apparatus of claim 1 wherein the sides of said channel void are separated from the edges of said first conductive sheet element by a distance approximately equal to said predetermined depth.

4. A microwave antenna apparatus comprising:

a thin sheet of dielectric material;

a first conductive sheet of predetermined planar configuration disposed on one face of said dielectric sheet, said first conductive sheet including a portion defining a microstrip antenna patch; and a second conductive sheet disposed on said one face of said dielectric sheet, said second conductive sheet including a channel wherein said second conductive sheet is transversely removed from said dielectric sheet by a first predetermined distance, said channel underlying and encompassing said first conductive sheet and conforming generally to said predetermined planar configuration and having sides laterally removed from the adjacent edges of said first conductive sheet by a second predetermined distance.

5. The apparatus of claim 4 wherein said second predetermined distance is approximately equal to said first predetermined distance.

6. The apparatus of claim 4 further comprising a third conductive sheet disposed on the face of said dielectric sheet opposing said one face, said third conductive sheet having a further channel wherein said third conductive sheet is transversely removed from said dielectric sheet by a third predetermined distance, said further channel generally conforming to said predetermined planar configuration, said further channel overlying and encompassing portions of said first conductive sheet, said third conductive sheet further having an opening overlying said microstrip antenna patch and being electrically connected to said second conductive sheet.

7. The apparatus of claim 6 wherein said third predetermined distance is approximately equal to said first predetermined distance.

8. In a radio frequency signal antenna structure of the type including a sheet of dielectric material, a first conductive strip element of predetermined planar configuration including a feedline portion and a microstrip antenna patch portion, and a second conductive sheet element, said first and second conductive elements being respectively affixed to first and second opposing surfaces of said dielectric sheet, the improvement wherein:

said second conductive element includes a portion forming a channel having sides tranverse to said dielectric sheet and a bottom separated from said dielectric sheet by a predetermined distance, said channel generally conforming to said predetermined planar configuration, and underlying both said feedline portion and said microstrip antenna patch portion of said first conductive element.

9. The improvement of claim 8 wherein:

said structure includes a third conductive element, generally adjacent and affixed to said first surface of said dielectric sheet and electrically connected to said second conductive element, the portions of said third conductive element in the vicinity of said first conductive element feedline portion being raised to form a further channel having sides transverse to said dielectric sheet at respective first and second predetermined distances from the edges of said first conductive element feedline portion and an upper member overlying said first conductive element feedline portion separated from said first conductive element feedline portion by a third predetermined distance;

said third conductive member further including an aperture, said aperture having edges at respective fourth and fifth predetermined distances from the edges of said first conductive element microstrip patch portion.

10. In a radio frequency signal antenna structure of the type including a sheet of dielectric material, a first conductive strip element of predetermined planar configuration, and a second conductive sheet element, said first and second conductive elements being respectively affixed to first and second opposing surfaces of said dielectric sheet, the improvement wherein:

said second conductive element includes a portion forming a channel having sides transverse to said dielectric sheet and a bottom separated from said dielectric sheet by a predetermined distance, said channel generally conforming to said predetermined planar configuration, and underlying said first conductive element; and said structure further comprises a third conductive element generally adjacent and affixed to said first surface of said dielectric sheet and electrically connected to said second conductive element, a portion of said third conductive element forming a further channel having sides transverse to said dielectric sheet and a top member separated from said dielectric sheet by a predetermined distance, said further channel generally conforming to said predetermined planar configuration, said first conductive element being within said channel and separated from said third conductive element.

11. A method of constructing a high efficiency structure for radiation of radio frequency signals comprising the steps of:

forming a first conductive sheet of predetermined planar configuration on one side of a sheet of dielectric material, said first conductive sheet including a feedline portion and microstrip antenna patch portion;

forming a second conductive sheet having a channel of generally said predetermined planar configuration and of predetermined depth; and disposing said second conductive sheet on the opposing side of said dielectric sheet, such that said channel underlines said feedline portion and said microstrip antenna patch portion of first conductive sheet.

12. The method of claim 11 further comprising the steps of:

forming, in a third conductive sheet a further channel of generally said predetermined planar configuraton, and of predetermined depth;

disposing said third conductive sheet on said one side of said dielectric sheet such that said further channel overlies and encompasses said first conductive sheet; and forming an opening in said third conductive sheet, disposed such that said opening overlies and encompasses said first conductive sheet radiating portion; and electrically connecting said second and third conductive sheets.

13. The method of claim 11 wherein said second conductive sheet forming step comprises stamping said channel in a planar conductive sheet.

14. The method of claim 11 wherein said second conductive sheet forming step comprises machining, in a conductive sheet of thickness greater than said predetermined depth, said channel.

15. The method of claim 11 wherein said second conductive sheet forming step comprises molding a conductive substance into a sheet having said channel.

16. The method of claim 11 wherein said second conductive sheet forming step comprises molding in non-conductive substance to form said sheet and channel; and depositing on the surface of said molded substance a conductive layer.

* * * * *